United States Patent [19]

Brandon et al.

[11] Patent Number: 4,849,281

[45] Date of Patent: Jul. 18, 1989

[54] GLASS MAT COMPRISING TEXTILE AND WOOL FIBERS

[75] Inventors: Ralph E. Brandon, Newark; Ben J. Yau, Reynoldsburg; Gregory S. Helwig, Granville, all of Ohio

[73] Assignee: Owens-Corning Fiberglas Corporation, Toledo, Ohio

[21] Appl. No.: 189,075

[22] Filed: May 2, 1988

[51] Int. Cl.[4] ..... D04H 1/08

[52] U.S. Cl. ..... 428/280; 428/288; 428/297

[58] Field of Search ..... 428/280, 288, 297

[56] References Cited

U.S. PATENT DOCUMENTS

| | | | |
|---|---|---|---|
| 4,472,243 | 9/1984 | Bondoc et al. | 428/300 |
| 4,508,777 | 4/1985 | Yamamoto et al. | 428/280 |
| 4,513,045 | 4/1985 | Bondoc et al. | 428/280 |

OTHER PUBLICATIONS

Fiberglas-Owens-Corning "Fiberglass Product for Papermaking" Feb. 1954.

*Primary Examiner*—James J. Bell

*Attorney, Agent, or Firm*—Patrick P. Pacella; Ronald E. Champion; Catherine Martineau

[57] ABSTRACT

A glass fibrous mat is disclosed which includes a blend of fibers comprising approximately 70–90%, by weight 6.5–13.0 micron in diameter wool fiber and approximately 10–30%, by weight, 7.5–13.5 micron in diameter, ⅛ to ½ inch in length textile glass fibers bonded together with a resin, binder material comprising a melamine cross-linked styrene-butadiene resin. The glass mat has been found to be highly satisfactory for use as an interlayer for compressible vinyl floor coverings.

6 Claims, No Drawings

GLASS MAT COMPRISING TEXTILE AND WOOL FIBERS

BACKGROUND OF THE INVENTION

This invention relates to mats for use in vinyl sheet flooring.

In one of its more specific aspects, this invention pertains to an all glass mat of both textile and wool fibers which mat is used as an interlayer for compressible vinyl floor covering.

A vinyl floor covering is typically composed of a number of layers including a wear layer, a print/foam layer, a glass mat layer and a backing layer. The wear layer is typically polyurethane and provides the hard, abrasion-resistant surface required for good durability. The print/foam layer carries the decorative print and is chemically foamed and embossed. The glass mat layer is typically a 1.0 lb/100 $ft^2$ mat produced with a suitable binder material. The backing layer is a vinyl film typically having the same mass as the print/foam layer. It may be solid or mechanically foamed and is present to completely encapsulate the glass mat as well as balance the construction of the vinyl floor covering.

All-glass flooring mat produced typically from 11 $\mu m \times 6$ mm textile fiber has been used in Europe for some time in an interlayer construction in which the glass mat is located essentially in the center of the vinyl floor covering. Unlike the vinyl floor covering produced with felt backings (asbestos or otherwise), the symmetry of the interlayer construction provides a lay flat-stay flat flooring that does not have to be glued to the subfloor in order to provide a stable floor covering. In addition, the interlayer construction is very flexible which makes do-it-yourself installation readily possible.

However, an all-glass flooring mat has not been widely accepted in this country because of a difference in building construction techniques in the U.S. versus Europe. A very high percentage of European subfloors are concrete as opposed to the joist and plywood subfloor system employed in the United. States. The interlayer constructed vinyl floor covering is a very dimensionally stable product which is desirable from a manufacturing standpoint and with installations over concrete. However, the interlayer construction has been found not to be particularly desirable when the vinyl floor covering is installed over a wood subfloor due to the fairly large dimensional changes associated with wood as the temperature and humidity changes. As the subfloor "dries out" in the winter time, it can shrink by up to 0.5 percent. Unless the vinyl floor covering can accommodate this change in dimension through compression, the vinyl floor covering will buckle to relieve the compressive loading. The glass mats currently used in the interlayer construction for the vinyl floor covering are very stiff and have high compressive strengths which can result in severe buckling of the floor covering when they are installed over wood subfloors.

Still, the use of glass mat for use as interlayers, for vinyl floor covering is well-known in the U.S. For example, the Bondoc, U.S. Pat. No. 4,269,886, discloses a mat which is produced of glass fibers ranging from $\frac{1}{4}$ to 3 inches in length and 3 to 20 microns in diameter. However, this mat is only 3.9 mil. to 11.8 mil. in thickness and has voids throughout at least 20% of the surface. Generally, such mats are too dimensionally stable for use over wood subfloors. The dimensional stability of the vinyl floor covering is an important consideration not only when the floor covering is being installed by using a perimeter adhesion installation technique but also when an overall gluing technique is used as well. In addition, it is desirable for glass mats used as interlayers for vinyl floor covering to possess acceptable compressibility when saturated with a binder material. It is a current practice to mechanically score the backing layer of the vinyl floor covering in order to have a covering with acceptable compressibility. This final step of mechanically scoring the backing layer results in much wasting of the covering since the scoring is done, at times, either too deep or too shallow into the backing layer. Either way, the final product must be scrapped.

Another concern in producing a commercially acceptable compressible vinyl floor covering is that the glass mat used as the interlayer possess sufficient hot tensile strength such that the glass mat does not separate or fall apart during the various manufacturing steps of either the glass mat itself or the vinyl floor covering. In the production of glass mats no manufacturer has previously been able to achieve the desirable low rigidity of the glass mat without compromising the hot tensile strength of the glass mat. If the glass mat does not possess sufficient hot tensile strength, the glass mat will not be commercially processible in existing floor covering manufacturing processes.

SUMMARY OF THE INVENTION

There has now been developed a glass mat which possesses such properties as hot tensile strength without compromising the desirable low rigidity of the glass mat. The glass mat of the present invention comprises an all glass composite comprising a blend of textile fibers and wool fibers bonded with an elastomeric binder material.

In a preferred embodiment, the blend of fibers comprises approximately 70–90%, by weight, wool fibers of about 6.5–13.5 micron in diameter, about 1.0 to 15 mm. in length, and approximately 10–30%, by weight, textile glass fibers, of about 7.5–13.5 micron in diameter, $\frac{1}{8}$ to $\frac{1}{2}$ inches (3–13 mm) in length bonded with approximately 20% of an adequately cross-linked polymeric binder material.

Blends of textile and wool glasses which contain polyester, polyamide or polyaramid fibers or combination of these can also be utilized to optimize mat textile and compressibility strengths to meet a specific flooring manufacturers requirements.

The mat of this invention has been found to be highly satisfactory for use as an interlayer for a compressible vinyl sheet flooring which is adhered to a wood subfloor.

DETAILED DESCRIPTION OF THE INVENTION

The invention provides a novel glass fiber mat which is particularly useful as an interlayer in a vinyl floor covering. The glass fiber mat of the present invention comprises a novel combination of glass wool fibers and glass textile fibers permeated with an elastomeric binder material. Wool fibers are used since the wool fibers have a tendency to bend more easily than textile fibers. In addition, the wool fibers are shorter and finer than textile fibers. The glass mats of the present invention which contain a predetermined amount of wool fibers thus have better compressibility than all glass fiber mats containing only textile fibers, as is the current practice.

The glass mat of the present invention comprises a blend of wool and textile glass fibers which, when blended together at optimum ratios, produces a mat having both sufficient room temperature dimensional stability and sufficient compressibility to avoid buckling problems of the vinyl floor covering. The glass mat of the present invention when used as an interlayer for a vinyl floor covering also has sufficient hot tensile strength to be produced commercially.

In a preferred embodiment, the glass mat of the present invention comprises approximately 70–90 percent, by weight, of the wool fibers and aproximately 10–30 percent, by weight of the textile fibers. The wool fibers preferably have a diameter of about 6.5 to 13.0 microns and a length of about 1.0 to 15.0 mm. while the textile glass fibers preferably have a diameter of about 7.5 to about 13.5 microns and a length of about 3 to 13 mm ($\frac{1}{8}$ to $\frac{1}{2}$ inches). It is desirable for the mat to have a thickness of about 0.25 to 0.5 mm; and, preferably about 0.35 to 0 0.4 mm. The wool fibers and textile fibers together comprise the fibrous material of the glass mat. The fibrous material comprises about 75% to 90%, by weight, of the glass mat and a binder material comprises about 10% to 25%, by weight, of the mat. A particularly useful combination of approximately 80%, by weight, 6.5 micron white wool fibers and about 20%, by weight, 7.5 micron$\times\frac{1}{4}$ or $\frac{1}{2}$ inch textile fibers bonded with an elastomeric binder resin. In a preferred embodiment the elastomeric binder material comprises about 10–25%, by weight, of the mat. The binder can be processed and still provide acceptable compressibility when the glass mat is saturated with the material used as the backing layer for the vinyl floor covering.

In one embodiment, the use of a melamine cross-linked styrene-butadiene binder provides a glass mat having adequate hot tensile strength while maintaining the compressibility of the vinyl-coated product. In a preferred embodiment the binder comprises approximately 50–90 percent carboxylated styrene-butadiene latex (Dow Latex 485), approximately 10–40 percent partially-methylated melamine-formaldehyde resin (Cymel 327, American Cyanamid), and approximately 0–40 percent urea formaldehyde resin (Cerac 240, Chembound Corp.). Several representative formulations and the associated mat properties are shown in the attached table. While each of the binder or resin formulations meets the requirements for hot tensile strength, there are differences in mat stiffness. As shown the table, a mat with a low stiffness gives very desirable compressive behavior in the final product. In a preferred embodiment the elastomeric binder material comprises approximately 55% carboxylated styrenebutadiene latex, approximately 40% partially-methylated melamine formaldehyde resin and approximately 4% urea formaldehyde resin.

Rigidity, as noted in the table as stiffness, is a measure of the vinyl flooring's ability to absorb compressive stress without buckling. The rigidity value represents the covering's deflection under a given stress, thus the smaller the number the better. Rigidity is positively effected (lowered) by lower loss on ignition (LOI) and larger fiber diameter. The effect of wool content is influenced by first order interactions between binder type and filament diameter. That is, for acrylic binder, rigidity is lowered by going to higher wool contents for all fiber diameters studied. For urea formaldehyde (UF) binder, however, higher wool content lowers the rigidity for 7.5 micron textile glass and increases it for 13.5 micron textile glass fiber. This behavior relates to the reduction in total numbers of fibers that occurs as 13.5 micron fiber is added and, hence, the "opening up" of the fiber matrix. In addition, the UF binder has poor film forming characteristics which leads to lower "wetted" area and hence weaker bonds. These two factors produce longer "free fiber units" in the matrix. Thus, the fibers have more freedom to move as a means of absorbing compression energy. The same factors contribute to the lower tensile strength observed for both 13.5 micron fiber and the UF binder.

The following example sets forth the procedure for producing a glass fibrous mat of the present invention.

The mats of this invention can be made utilizing well-known wet-laid non-woven technology. In a preferred embodiment, however, the mats are made by dispersing an appropriate fiber blend, e.g., 90% by weight 6.5 μm wool fibers and 10% by weight 7.5 μm $\frac{1}{2}$" textile fibers, in an aqueous medium containing a suitable dispersant such as Katapol VP532 available from the GAF Company and a viscosity modifier such as Separan R which is a partially hydrolyzed polyacrylamide. The fibers are then withdrawn as a wet-laid mat from the aqueous medium, which process is well-known in that art.

The resin binder material can be applied to the wet-formed mat in any suitable manner, all of which methods are known in the art. For example, the resin binder material can be sprayed on, or poured over the mat and excess resin binder material removed under vacuum. In the final cured mat, the resin binder material comprises approximately 10 to about 25 weight percent of the mat. The resin binder material on the mat can be cured in any suitable manner sufficient to dry and cure the components of the resin binder material and to produce a glass mat having the desirable hot tensile strength needed for manufacturing the glass mat without compromising the desirable compressibility of the glass mat.

It will be evident from the foregoing that various modifications can be made to this invention. Such, however, are within the scope of the invention.

EFFECT OF BINDER COMPOSITION ON FLOORING MAT PROPERTIES

| BINDER COMPONENTS (WT. FRACTION) | | | BINDER | MAT PROPERTIES | | |
|---|---|---|---|---|---|---|
| | | | | TENSILE STRENGTH (LB/IN) | | |
| SBR LATEX | MELAMINE RESIN | UF RESIN | LOSS-ON IGNITION | 77° F. | 350° F. | HANDLE-O-METER STIFFNESS (g) |
| .50 | .10 | .40 | 16.2 | 12.6 | 10.3 | 21.5 |
| .70 | .10 | .20 | 16.1 | 13.1 | 8.0 | 20.6 |
| .50 | .25 | .25 | 15.0 | 12.5 | 8.6 | 19.9 |

-continued

| EFFECT OF BINDER COMPOSITION ON FLOORING MAT PROPERTIES | | | | | | |
|---|---|---|---|---|---|---|
| BINDER COMPONENTS (WT. FRACTION) | | | BINDER | MAT PROPERTIES | | |
| | | | | TENSILE STRENGTH (LB/IN) | | |
| SBR LATEX | MELAMINE RESIN | UF RESIN | LOSS-ON IGNITION | 77° F. | 350° F. | HANDLE-O-METER STIFFNESS (g) |
| .55 | .40 | .05 | 14.1 | 9.3 | 8.1 | 11.1 |

Fiber Content:
80% 6.5 micron wool fiber
20% 7.5 micron ½ in. textile fiber

We claim:

1. A compressible gas fiber mat consisting of a blend of approximately 70–90 percent, by weight, of glass wool fibers having a diameter from about 6.5 to about 13.0 microns, and approximately 10–30 percent, by weight, of textile glass fibers having a diameter from about 7.5 to about 13.0 microns and from about ⅛ to ½ inches in length, and a binder formed by removing water from an aqueous composition comprising a melamine cross-linked styrene-butadiene resin elastomeric binder material.

2. The glass fiber mat of claim 1 wherein the blend of fibers comprises about 80 percent, by weight, glass wool fibers and about 20 percent, by weight, textile fibers.

3. The glass fiber mat of claim 1, wherein the glass wool fibers have a diameter of about 6.5 microns and the textile fibers have a diameter of about 7.5 microns and a length of about ½ inches.

4. The glass fiber mat of claim 1, wherein the elastomeric binder material comprises about 10–25 percent, by weight, of the mat.

5. The glass fiber mat of claim 1, wherein the elastomeric binder material comprises approximately 50–90 percent carboxylated styrene-butadiene latex, approximately 10–40 percent partially-methylated melamine-formaldehyde resin and approximately 0–40 percent urea formaldehyde resin.

6. The glass fiber mat of claim 5, wherein the elastomeric binder material comprises approximately 55 percent carboxylated styrene-butadiene latex, approximately 40 percent partially-methylated melamine formaldehyde resin and approximately 4 percent urea formaldehyde resin.

* * * * *